US008408240B2

(12) United States Patent
Huang

(10) Patent No.: US 8,408,240 B2
(45) **Date of Patent: *Apr. 2, 2013**

(54) WALL-MOUNTED FAUCET THAT IS AVAILABLE FOR WATER SUPPLY LINES OF DIFFERENT SPECIFICATIONS AND SIZES

(75) Inventor: Li-Chen Huang, Changhua Hsien (TW)

(73) Assignee: Alexander Yeh Industry Co., Ltd., Changhua Hsien (TW)

( * ) Notice: Subject to any disclaimer, the term of this patent is extended or adjusted under 35 U.S.C. 154(b) by 0 days.

This patent is subject to a terminal disclaimer.

(21) Appl. No.: 13/093,105

(22) Filed: Apr. 25, 2011

(65) Prior Publication Data

US 2012/0266989 A1 Oct. 25, 2012

(51) Int. Cl.
*F16L 5/00* (2006.01)

(52) U.S. Cl. ..... 137/360; 137/801

(58) Field of Classification Search ..... 239/600; 137/359, 360, 801; 4/675, 678
See application file for complete search history.

(56) References Cited

U.S. PATENT DOCUMENTS

| | | | | |
|---|---|---|---|---|
| 3,136,570 | A * | 6/1964 | Lee | 285/193 |
| 6,175,972 | B1 * | 1/2001 | Wales | 4/678 |
| 6,192,529 | B1 * | 2/2001 | Jones et al. | 4/615 |
| 6,267,145 | B1 * | 7/2001 | Sun | 137/801 |
| 6,334,463 | B1 * | 1/2002 | Lee | 137/801 |
| 6,840,267 | B1 * | 1/2005 | Jennings et al. | 137/360 |
| 7,258,322 | B1 * | 8/2007 | Yang | 251/323 |
| 7,373,674 | B1 * | 5/2008 | Condon | 4/678 |

* cited by examiner

*Primary Examiner* — John K Fristoe, Jr.
*Assistant Examiner* — Angelisa Hicks
(74) *Attorney, Agent, or Firm* — Alan Kamrath; Kamrath IP Lawfirm, P.A.

(57) ABSTRACT

A faucet includes a faucet body, a connecting member mounted in the faucet body, a plurality of elastic plates each connected between the faucet body and the connecting member, a first connector selectively connected with the connecting member, and a second connector selectively connected with the connecting member. Thus, the connecting member is connected with a water supply line by the first connector or the second connector so that the faucet is available for water supply lines of different types and sizes.

15 Claims, 6 Drawing Sheets

WALL-MOUNTED FAUCET THAT IS AVAILABLE FOR WATER SUPPLY LINES OF DIFFERENT SPECIFICATIONS AND SIZES

BACKGROUND OF THE INVENTION

1. Field of the Invention

The present invention relates to a faucet and, more particularly, to a wall-mounted faucet.

2. Description of the Related Art

A conventional faucet comprises a faucet body, a connecting member mounted in the faucet body and connected with a water supply line to introduce water from the water supply line into the faucet body, and a control valve mounted between the faucet body and the connecting member to switch a connection between the faucet body and the connecting member so as to open or close the water flow from the connecting member to the faucet body. The water supply line is mounted in the wall of a house. The connecting member is connected with the faucet body by screws. However, the connecting member is only available for the water supply line of a single size and cannot fit another water supply line with different sizes and types, thereby limiting the versatility of the faucet. In addition, the connecting member is connected with the faucet body by multiple screws, so that the faucet is not assembled easily and quickly, thereby causing inconvenience to a user in assembly of the faucet. Further, the screws are rusted by water or moisture during a long-term utilization so that the screws will be corroded or jammed and cannot be loosened or unscrewed easily and quickly, thereby greatly causing difficulty in maintenance and replacement of the faucet.

BRIEF SUMMARY OF THE INVENTION

In accordance with the present invention, there is provided a faucet, comprising a faucet body, a connecting member mounted in the faucet body, a plurality of elastic plates each connected between the faucet body and the connecting member, a first connector selectively connected with the connecting member, and a second connector selectively connected with the connecting member. The faucet body has an inner portion provided with a receiving chamber. The faucet body has a first end provided with an opening, a mediate portion provided with a conduit and a second end provided with an outlet port. The connecting member is received in the receiving chamber of the faucet body. The connecting member has a first end connected with a disk which is located in the opening of the faucet body to seal the opening of the faucet body. The connecting member has a second end provided with a reduced mounting tube which is connected with the conduit of the faucet body. The disk is provided with a mounting sleeve. The mounting sleeve of the disk has an inner portion provided with a mounting hole. The first connector is removably mounted in the mounting hole of the mounting sleeve. The second connector is removably mounted in the mounting hole of the mounting sleeve.

The primary objective of the present invention is to provide a wall-mounted faucet that is available for water supply lines of different specifications and sizes.

According to the primary advantage of the present invention, the connecting member is connected with the water supply line by the first connector or the second connector so that the faucet is available for water supply lines of different types and sizes to enhance the versatility and compatibility of the faucet.

According to another advantage of the present invention, the connecting member is combined with the faucet body by elastic connection of the elastic plates so that the connecting member is repaired and replaced easily and quickly.

Further benefits and advantages of the present invention will become apparent after a careful reading of the detailed description with appropriate reference to the accompanying drawings.

BRIEF DESCRIPTION OF THE SEVERAL VIEWS OF THE DRAWING(S)

DETAILED DESCRIPTION OF THE INVENTION

Figure 1:
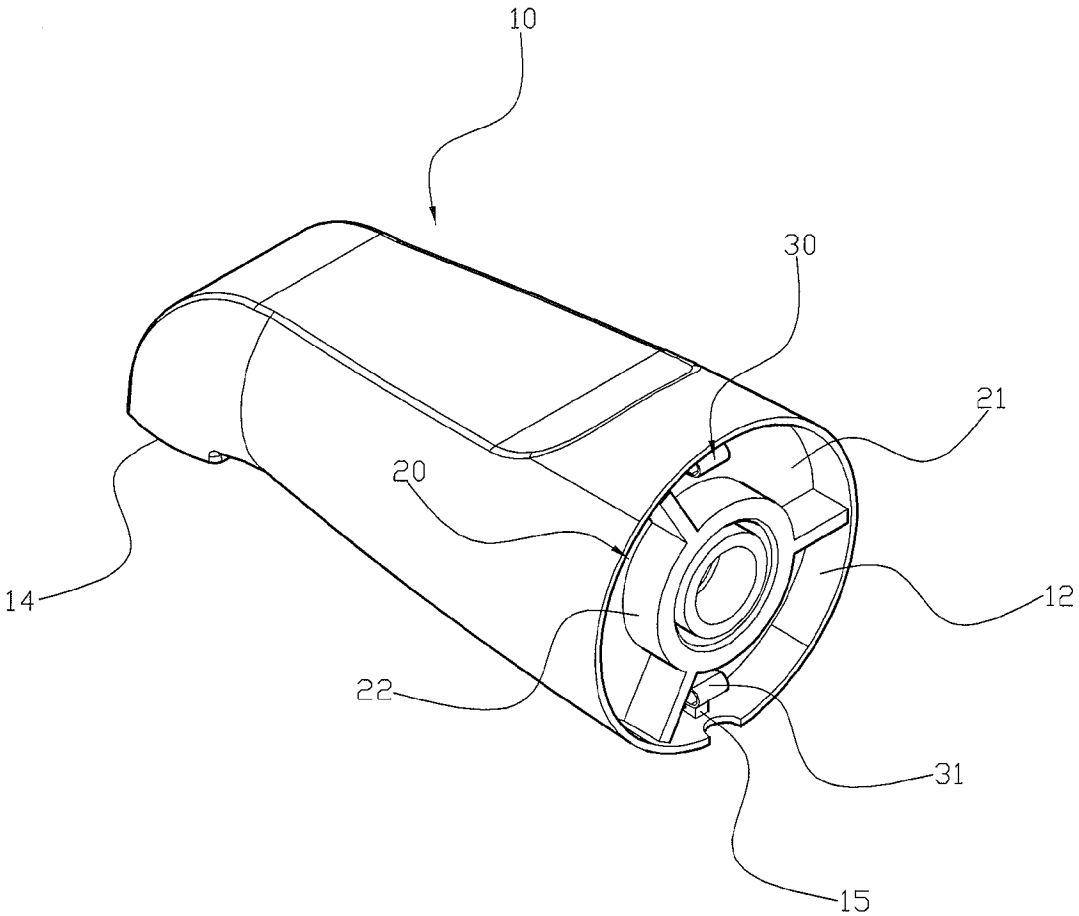
FIG. 1 is a perspective view of a faucet in accordance with the preferred embodiment of the present invention.

Referring to the drawings and initially to FIGS. 1-4, a faucet in accordance with the preferred embodiment of the present invention comprises a hollow faucet body 10, a connecting member 20 mounted in the faucet body 10, a plurality of elastic plates 30 each connected between the faucet body 10 and the connecting member 20, a first connector 40 selectively connected with the connecting member 20, and a second connector 50 selectively connected with the connecting member 20.

The faucet body 10 has an inner portion provided with a receiving chamber 11. The faucet body 10 has a first end provided with an opening 12, a mediate portion provided with a conduit 13 and a second end provided with an outlet port 14. The receiving chamber 11 of the faucet body 10 is connected between the opening 12 and the conduit 13 of the faucet body 10 and has a peripheral wall provided with a plurality of retaining blocks 15. Each of the retaining blocks 15 of the faucet body 10 is located beside the opening 12 of the faucet body 10 and has a face provided with a locking slit 16. Each of the retaining blocks 15 of the faucet body 10 extends in an axial direction of the faucet body 10, and the locking slit 16 of each of the retaining blocks 15 extends in a direction that is perpendicular to each of the retaining blocks 15. The conduit 13 of the faucet body 10 is connected between the receiving chamber 11 and the outlet port 14 of the faucet body 10.

The connecting member 20 is received in the receiving chamber 11 of the faucet body 10. The connecting member 20 has a first end connected with a disk 21 which is located in the opening 12 of the faucet body 10 to seal the opening 12 of the faucet body 10. The connecting member 20 has a second end provided with a reduced mounting tube 27 which is connected with the conduit 13 of the faucet body 10. The disk 21 is provided with a mounting sleeve 22 which is located at a central portion of the disk 21. The mounting sleeve 22 of the disk 21 has a first end protruded from a first side of the disk 21 and inserted into the connecting member 20 and a second end protruded from a second side of the disk 21 and exposed from the opening 12 of the faucet body 10. The mounting sleeve 22 of the disk 21 has an inner portion provided with a mounting hole 23. The mounting hole 23 of the mounting sleeve 22 has a peripheral wall provided with an internal thread 231. The disk 21 has a periphery provided with a plurality of retaining recesses 25 locked onto the retaining blocks 15 of the faucet body 10 respectively. The disk 21 has a surface provided with a plurality of elongate retaining slots 26 aligning with the retaining recesses 25. Each of the retaining slots 26 extends through a whole thickness of the disk 21. The connecting member 20 has an inner portion provided with a compartment 200 connected between the mounting hole 23 of the mounting sleeve 22 and the mounting tube 27.

Each of the elastic plates 30 has a substantially U-shaped elastic portion 31 which has a first side provided with a first locking blade 32 snapped into and locked in the locking slit 16 of a respective one of the retaining blocks 15 of the faucet body 10 and has a second side provided with a second locking blade 33 hooked in a respective one of the retaining slots 26 of the disk 21 of the connecting member 20 so that each of the elastic plates 30 is biased between the faucet body 10 and the connecting member 20 to combine the faucet body 10 and the connecting member 20. The second locking blade 33 of each of the elastic plates 30 has a length greater than that of the first locking blade 32.

The first connector 40 is removably mounted in the mounting hole 23 of the mounting sleeve 22. The first connector 40 has a tubular shape and has an inner portion provided with a mounting bore 400, and a leakproof ring 43 is mounted in the mounting bore 400 of the first connector 40. The first connector 40 has an outer wall provided with an external thread 403 screwed into the internal thread 231 of the mounting sleeve 22. The first connector 40 has a peripheral wall provided with a screw bore 402 connected to the mounting bore 400 of the first connector 40, and a threaded pressing member 42 is screwed into the screw bore 402 of the first connector 40 and is extended into the mounting bore 400 of the first connector 40. The threaded pressing member 42 is preferably a set screw.

The second connector 50 is removably mounted in the mounting hole 23 of the mounting sleeve 22. The second connector 50 has a tubular shape. The second connector 50 has an outer wall provided with an external thread 52 screwed into the internal thread 231 of the mounting sleeve 22 and has an inner wall provided with an inner threaded portion 51. The second connector 50 has an end portion provided with a plurality of tool slots 53 to allow insertion of a hand tool, such as a driver and the like, so that the second connector 50 can be driven and rotated by the hand tool.

In the preferred embodiment of the present invention, the mounting hole 23 of the mounting sleeve 22 has a distal end provided with a reduced stop flange 24, and a spacer 41 is mounted in the mounting hole 23 of the mounting sleeve 22 and is located between the stop flange 24 of the mounting sleeve 22 and the first connector 40 or the second connector 50. The mounting sleeve 22 has a periphery provided with an extension pipe 28 which is extended into the compartment 200 of the connecting member 20. The extension pipe 28 has an inner wall provided with a plurality of engaging ribs 29 (see FIG. 5).

Figure 2:
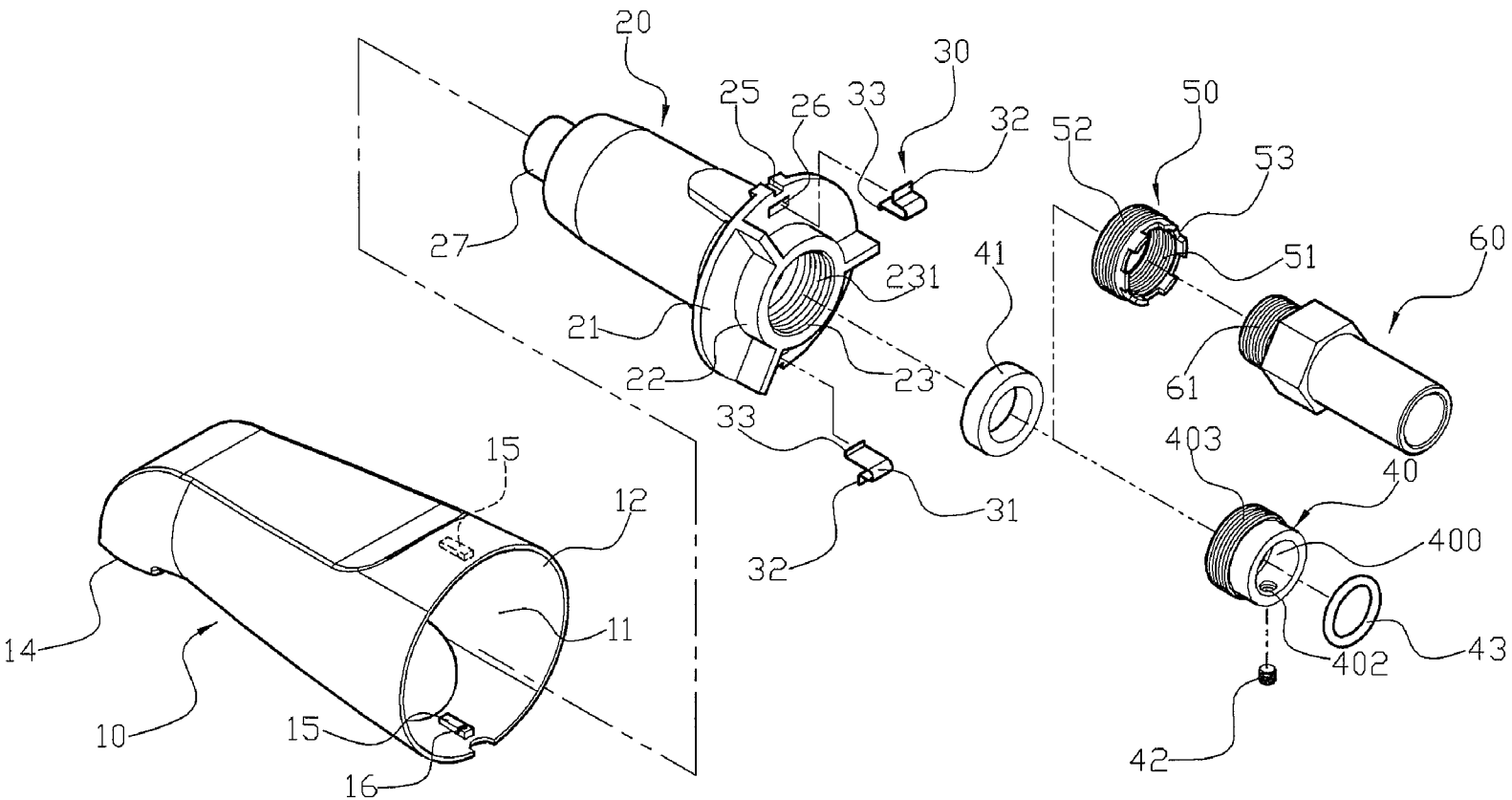
FIG. 2 is an exploded perspective view of the faucet as shown in FIG. 1.
Figure 3:
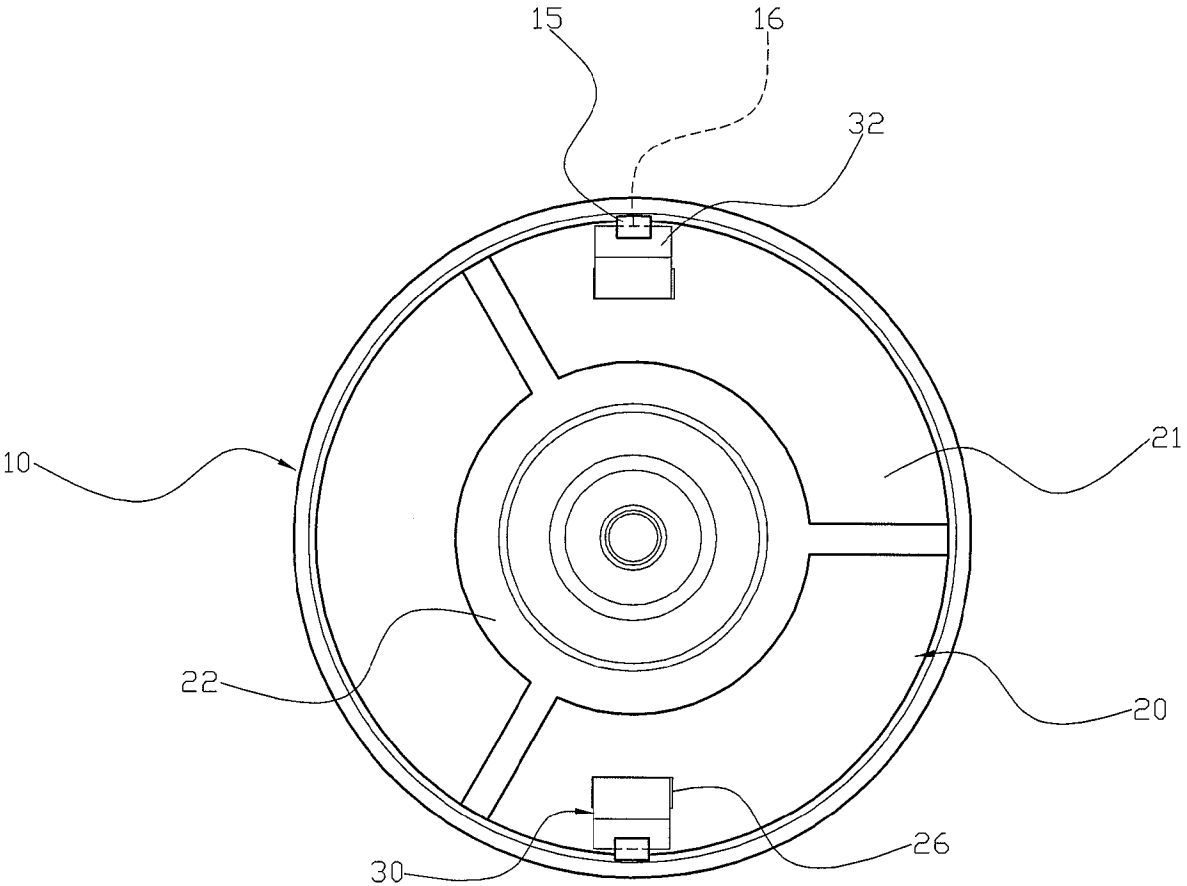
FIG. 3 is a side view of the faucet as shown in FIG. 1.
Figure 4:
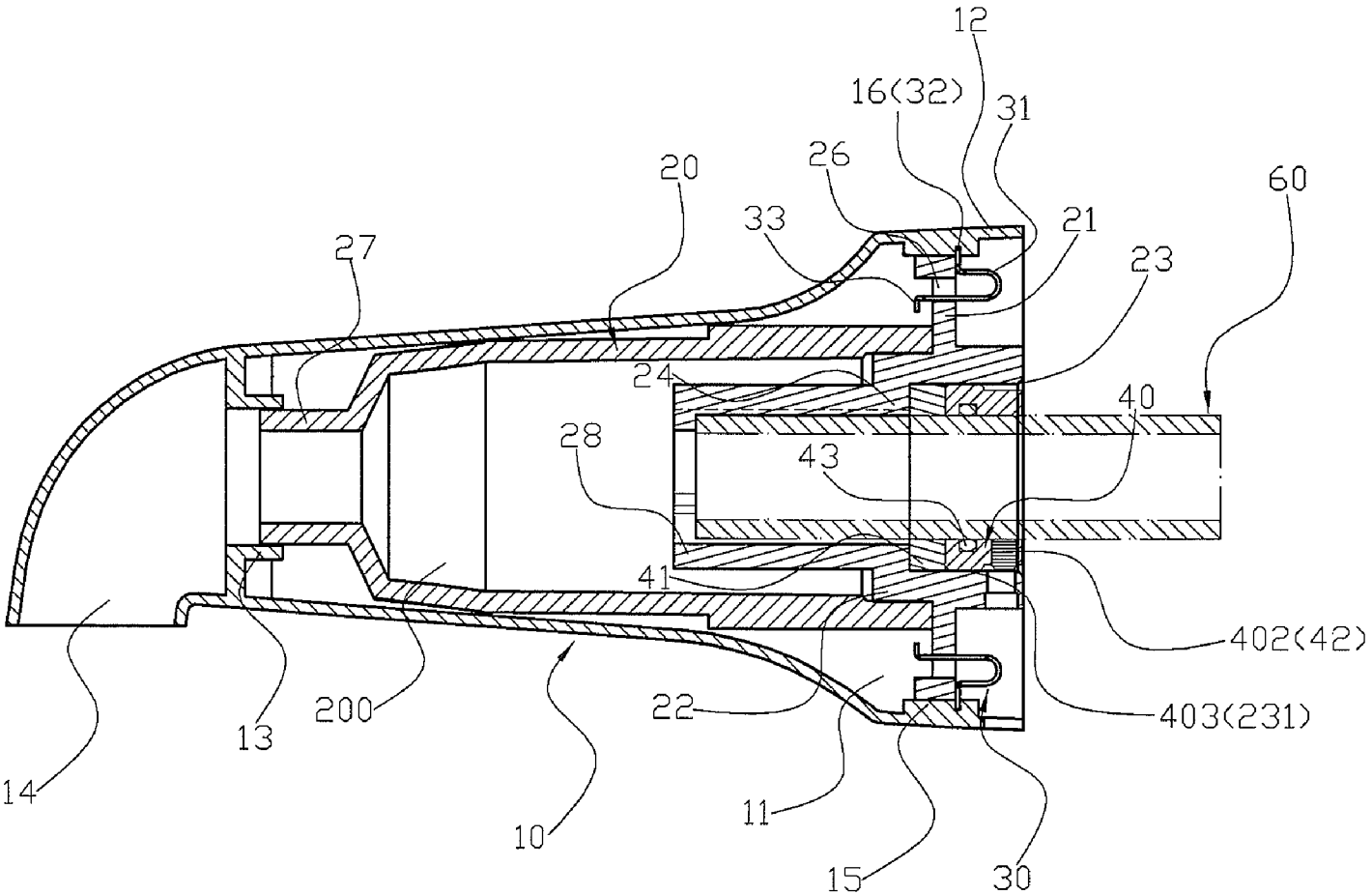
FIG. 4 is a front cross-sectional assembly view of the faucet as shown in FIG. 2.
Figure 5:
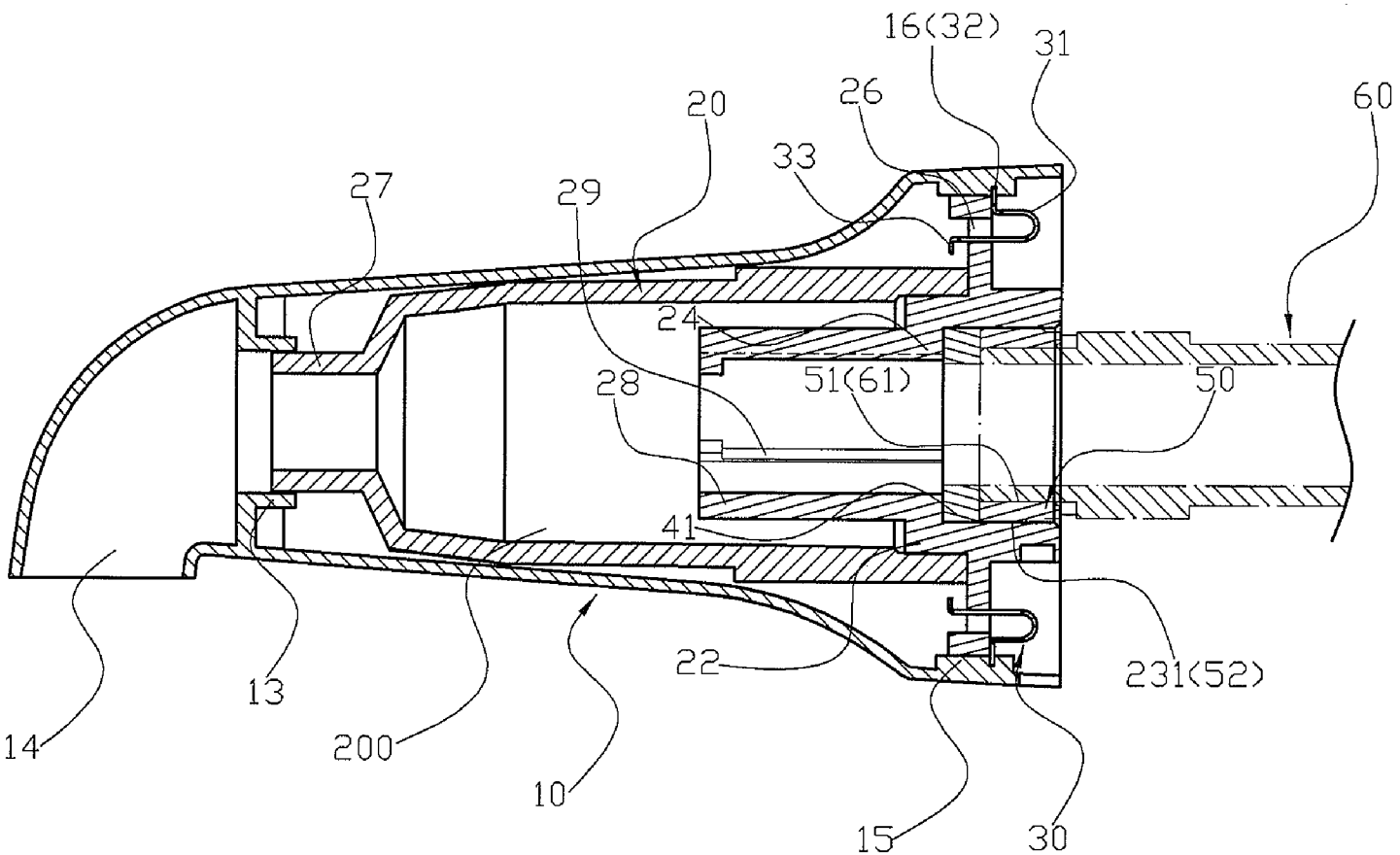
FIG. 5 is a front cross-sectional assembly view of the faucet as shown in FIG. 2.
Figure 6:
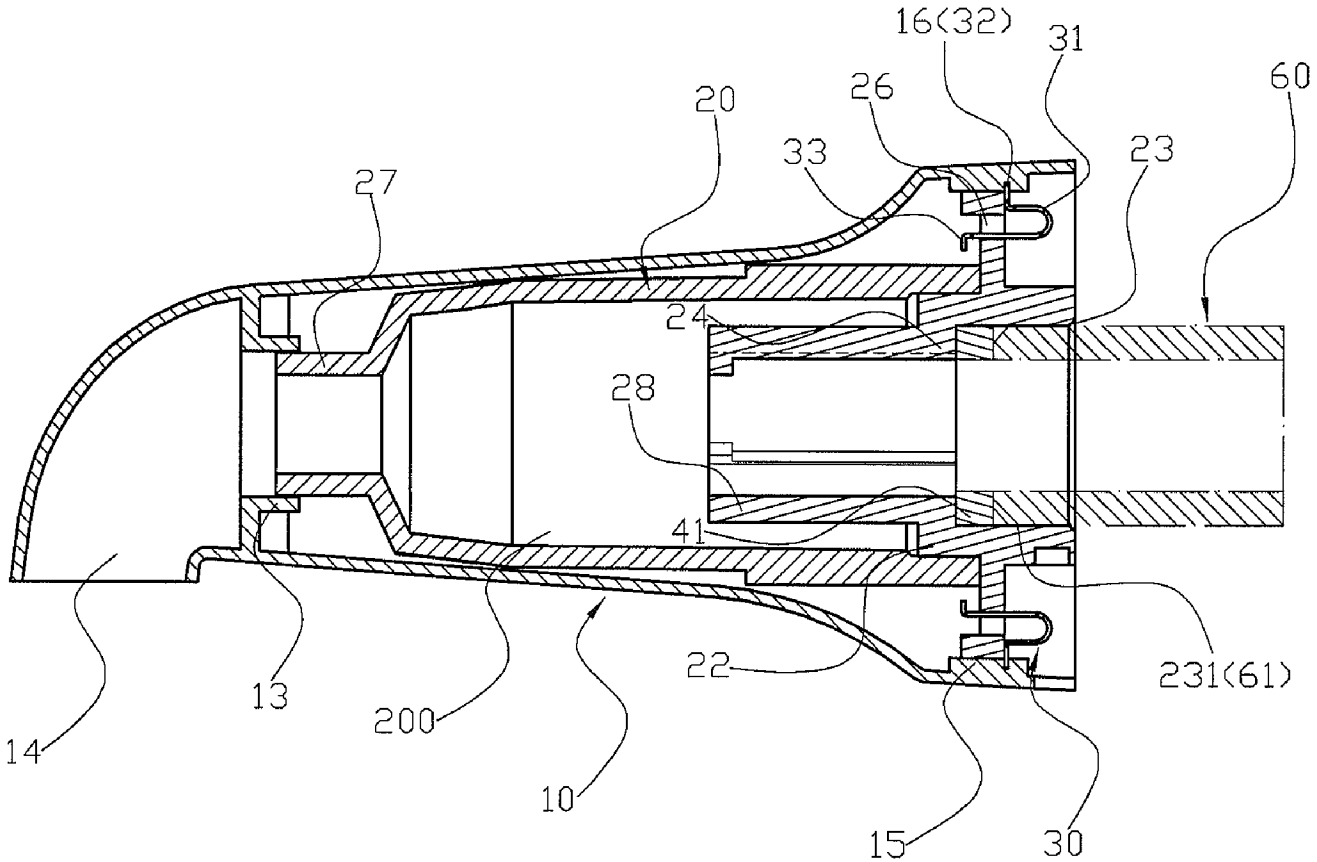
FIG. 6 is a schematic operational view of the faucet as shown in FIG. 4.

In assembly, referring to FIGS. 4-6 with reference to FIGS. 1-3, the first connector 40 and the second connector 50 are used to connect a water supply line 60. When the water supply line 60 is not screwed, the first connector 40 is directly mounted on an end portion of the water supply line 60, and the threaded pressing member 42 is screwed into the screw bore 402 of the first connector 40 and is extended into the mounting bore 400 of the first connector 40 to press the end portion of the water supply line 60 so that the first connector 40 is locked onto the end portion of the water supply line 60. Then, the spacer 41 is placed into the mounting hole 23 of the mounting sleeve 22, and the internal thread 231 of the mounting sleeve 22 is screwed onto the external thread 403 of the first connector 40 to connect the connecting member 20 with the water supply line 60 so that the faucet is combined with the water supply line 60 as shown in FIG. 4. At this time, the extension pipe 28 in the connecting member 20 is used to support the water supply line 60 so that the connecting member 20 is combined with the water supply line 60 solidly and stably.

When the end portion of the water supply line 60 is provided with an outer threaded portion 61, the external thread 52 of the second connector 50 is initially screwed into the internal thread 231 of the mounting sleeve 22 to lock the second connector 50 in the mounting sleeve 22. Then, the inner threaded portion 51 of the second connector 50 is screwed onto the outer threaded portion 61 of the water supply line 60 to lock the second connector 50 onto the water supply line 60 so as to connect the connecting member 20 with the water supply line 60 so that the faucet is combined with the water supply line 60 as shown in FIG. 5. At this time, the engaging ribs 29 of the extension pipe 28 engage the outer wall of the water supply line 60 so that the extension pipe 28 is combined with the water supply line 60 closely.

Alternatively, when the water supply line 60 has a larger diameter, the internal thread 231 of the mounting sleeve 22 is directly screwed onto the outer threaded portion 61 of the water supply line 60 as shown in FIG. 6 to lock the mounting sleeve 22 onto the water supply line 60 so as to connect the connecting member 20 with the water supply line 60 so that the faucet is combined with the water supply line 60.

When in use, the water from the water supply line 60 in turn flows through the mounting sleeve 22 of the disk 21, the compartment 200 of the connecting member 20, the mounting tube 27 of the connecting member 20 and the conduit 13 of the faucet body 10 into the outlet port 14 of the faucet body 10 and then flows outward from the outlet port 14 of the faucet body 10 for use with a user.

Accordingly, the connecting member 20 is connected with the water supply line 60 by the first connector 40 or the second connector 50 so that the faucet is available for water supply lines of different types and sizes to enhance the versatility and compatibility of the faucet. In addition, the connecting member 20 is combined with the faucet body 10 by elastic connection of the elastic plates 30 so that the connecting member 20 is repaired and replaced easily and quickly.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

The invention claimed is:

1. A faucet, comprising:

a faucet body;

a connecting member mounted in the faucet body;

a plurality of elastic plates each connected between the faucet body and the connecting member;

a first connector selectively connected with the connecting member;

a second connector selectively connected with the connecting member;

wherein the faucet body has an inner portion provided with a receiving chamber;

the faucet body has a first end provided with an opening, a mediate portion provided with a conduit and a second end provided with an outlet port;

the connecting member is received in the receiving chamber of the faucet body;

the connecting member has a first end connected with a disk which is located in the opening of the faucet body to seal the opening of the faucet body;

the connecting member has a second end provided with a reduced mounting tube which is connected with the conduit of the faucet body;

the disk is provided with a mounting sleeve;

the mounting sleeve of the disk has an inner portion provided with a mounting hole;

either the first connector or the second connector is removably mounted in the mounting hole of the mounting sleeve;

the receiving chamber of the faucet body has a peripheral wall provided with a plurality of retaining blocks;

each of the retaining blocks of the faucet body has a face provided with a locking slit;

the disk has a periphery provided with a plurality of retaining recesses locked onto the retaining blocks of the faucet body respectively;

the disk has a surface provided with a plurality of elongate retaining slots aligning with the retaining recesses;

each of the elastic plates has an elastic portion which has a first side provided with a first locking blade snapped into and locked in the locking slit of a respective one of the retaining blocks of the faucet body and has a second side provided with a second locking blade hooked in a respective one of the retaining slots of the disk of the connecting member;

each of the elastic plates is biased between the faucet body and the connecting member to combine the faucet body and the connecting member.

2. The faucet of claim 1, wherein the elastic portion of each of the elastic plates has a substantially U-shaped profile.

3. The faucet of claim 1, wherein the first connector has an inner portion provided with a mounting bore;

the first connector has a peripheral wall provided with a screw bore connected to the mounting bore of the first connector;

a threaded pressing member is screwed into the screw bore of the first connector and extended into the mounting bore of the first connector.

4. The faucet of claim 3, wherein a leakproof ring is mounted in the mounting bore of the first connector.

5. The faucet of claim 1, wherein the second connector has an inner wall provided with an inner threaded portion.

6. The faucet of claim 1, wherein the second connector has an end portion provided with a plurality of tool slots.

7. The faucet of claim 1, wherein the mounting hole of the mounting sleeve, has a distal end provided with a reduced stop flange;

a spacer is mounted in the mounting hole of the mounting sleeve and is located between the stop flange of the mounting sleeve and the first connector or the second connector.

8. The faucet of claim 1, wherein the connecting member has an inner portion provided with a compartment connected between the mounting hole of the mounting sleeve and the mounting tube;

the mounting sleeve has a periphery provided with an extension pipe which is extended into the compartment of the connecting member.

9. The faucet of claim 8, wherein the extension pipe has an inner wall provided with a plurality of engaging ribs.

10. The faucet of claim 1, wherein each of the retaining blocks of the faucet body extends in an axial direction of the faucet body;

the locking slit of each of the retaining blocks extends in a direction that is perpendicular to each of the retaining blocks.

11. The faucet of claim 1, wherein each of the retaining blocks of the faucet body is located beside the opening of the faucet body;

each of the retaining slots extends through a whole thickness of the disk.

12. The faucet of claim 1, wherein the receiving chamber of the faucet body is connected between the opening and the conduit of the faucet body;

the conduit of the faucet body is connected between the receiving chamber and the outlet port of the faucet body.

13. The faucet of claim 1, wherein the second locking blade of each of the elastic plates has a length greater than that of the first locking blade.

14. A faucet, comprising:

a faucet body;

a connecting member mounted in the faucet body;

a plurality of elastic plates each connected between the faucet body and the connecting member;

a first connector selectively connected with the connecting member;

a second connector selectively connected with the connecting member;

wherein the faucet body has an inner portion provided with a receiving chamber;

the faucet body has a first end provided with an opening, a mediate portion provided with a conduit and a second end provided with an outlet port;

the connecting member is received in the receiving chamber of the faucet body;

the connecting member has a first end connected with a disk which is located in the opening of the faucet body to seal the opening of the faucet body;

the connecting member has a second end provided with a reduced mounting tube which is connected with the conduit of the faucet body;

the disk is provided with a mounting sleeve;

the mounting sleeve of the disk has an inner portion provided with a mounting hole;

either the first connector or the second connector is removably mounted in the mounting hole of the mounting sleeve;

the mounting hole of the mounting sleeve has a peripheral wall provided with an internal thread;

the first connector has an outer wall provided with an external thread that can be screwed into the internal thread of the mounting sleeve;

the second connector has an outer wall provided with an external thread that can be screwed into the internal thread of the mounting sleeve.

15. A faucet, comprising:

a faucet body;

a connecting member mounted in the faucet body;

a plurality of elastic plates each connected between the faucet body and the connecting member;

a first connector selectively connected with the connecting member;

a second connector selectively connected with the connecting member;

wherein the faucet body has an inner portion provided with a receiving chamber;

the faucet body has a first end provided with an opening, a mediate portion provided with a conduit and a second end provided with an outlet port;

the connecting member is received in the receiving chamber of the faucet body;

the connecting member has a first end connected with a disk which is located in the opening of the faucet body to seal the opening of the faucet body;

the connecting member has a second end provided with a reduced mounting tube which is connected with the conduit of the faucet body;

the disk is provided with a mounting sleeve;

the mounting sleeve of the disk has an inner portion provided with a mounting hole;

either the first connector or the second connector is removably mounted in the mounting hole of the mounting sleeve;

the mounting sleeve of the disk has a first end protruded from a first side of the disk and inserted into the connecting member and a second end protruded from a second side of the disk and exposed from the opening of the faucet body.

* * * * *